United States Patent [19]

McAllister

[11] 4,423,662

[45] Jan. 3, 1984

[54] MUZZLE ARC SUPPRESSOR FOR ELECTROMAGNETIC PROJECTILE LAUNCHER

[75] Inventor: Dan R. McAllister, Sunnyvale, Calif.

[73] Assignee: Westinghouse Electric Corp., Pittsburgh, Pa.

[21] Appl. No.: 309,862

[22] Filed: Oct. 8, 1981

[51] Int. Cl.[3] ..... F41F 1/00

[52] U.S. Cl. ..... 89/8; 124/3

[58] Field of Search ..... 89/8; 124/3; 310/10

[56] References Cited

U.S. PATENT DOCUMENTS 2,790,354 4/1957 Yoler et al. ..... 89/8

4,343,223 8/1982 Hawke et al. ..... 89/8

OTHER PUBLICATIONS

EP-T12, (3/72), Barber, pp. 117-120, Australian National U., "Hypervelocity Electromagnetic Accelerator".

UCRL-52778, Part 2, p. 4, (7/79), Hawke, "Railgun Accelerators".

*Primary Examiner*—Sal Cangialosi

*Attorney, Agent, or Firm*—F. J. Baehr, Jr.

[57] ABSTRACT

An electromagnetic projectile launcher having a pair of conductive rails with a breech and a nozzle end and an impedance electrically connected across the conductive rails adjacent the muzzle end of the conductive rails, and a second impedance which increases as the distance to the muzzle decreases, is disposed in the muzzle end of the rails and in arcs confined within the muzzle to commutate the current to the first impedance to substantially suppress any external arc as the projectile exits from the launcher.

5 Claims, 2 Drawing Figures

MUZZLE ARC SUPPRESSOR FOR ELECTROMAGNETIC PROJECTILE LAUNCHER

CROSS-REFERENCE TO RELATED APPLICATION

This application is closely related to an application filed the same day and identified by assignee No. 49,401.

BACKGROUND OF THE INVENTION

This invention relates to electromagnetic projectile launchers, and more particularly to a muzzle arc suppressor for such devices.

In electromagnetic projectile launchers, a sliding electrical conductor, an armature or, alternatively, an arc between the rails, with an insulating sabot, accelerates a projectile to terminal velocity within the barrel length. This acceleration is produced by the interaction of the armature current and the magnetic field produced by the same current flowing in the conductive rails within the barrel. When the armature leaves the muzzle, the electrical circuit is opened, causing an arc to form. This arc will produce an intense flash which is easily detected both visibly and electromagnetically from a great distance and will cause erosion and thermal damage to the rails within the muzzle. These occurrences are particularly undesirable if the electromagnetic launcher is used for military applications.

SUMMARY OF THE INVENTION

In general, an electromagnetic projectile launcher, when made in accordance with this invention, comprises a pair of generally parallel conductors having a breech and a muzzle end, an armature slidably disposed between the conductors, a source of high current connected to the conductors, a first impedance disposed across the conductors adjacent the muzzle end thereof, and a second impedance disposed in at least one of said conductors on the muzzle side of where the first impedance is connected across the conductors, the second impedance increasing as the distance to the muzzle decreases, whereby current is commutated to the first impedance to suppress muzzle arcing.

BRIEF DESCRIPTION OF THE DRAWINGS

The objects and advantages of this invention will become more apparent from reading the following detailed description in conjunction with the accompanying drawings, in which.

DESCRIPTION OF THE PREFERRED EMBODIMENT

Figure 1:
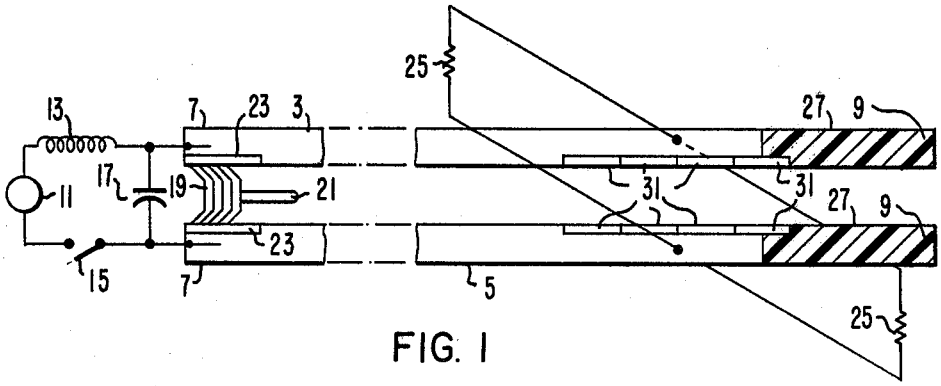
FIG. 1 is a schematic diagram of an electromagnetic projectile launcher made in accordance with this invention.

Referring now to the drawings in detail and in particular to FIG. 1, there is shown an electromagnetic projectile system which comprises a pair of parallel conductive rails 3 and 5, respectively, disposed in a barrel (not shown), having a breech and muzzle end 7 and 9, respectively, a homopolar generator 11 or other means for supplying high current, an induction coil 13 and a makeswitch 15 connected in series to the breech ends 7 of the conductors 3 and 5. A circuit breaker 17 is electrically connected across the breech end of the conductive rails 3 and 5.

An armature 19 or other means such as an arc and sabot is utilized for conducting current between the conductors 3 and 5 and for accelerating a projectile 21 as it moves from the breech 7 to the muzzle 7 end of the conductive rails. On the breech end of the conductive rails are resistive inserts 23 or other means which prevent premature launching and heating of the armature and conductive rails before the circuit breaker 17 is opened to commence firing.

An impedance 25 is electrically connected across the conductive rails adjacent the muzzle end 9. The impedance 25 preferably has a low inductance and may be made of tungsten or other material in which the resistance increases as the temperature increases to assist in rapidly commutating the current to the impedance 25. The impedance 25 may be symmetrically disposed on both sides of the conductive rails as shown in FIG. 1; and as shown in FIG. 2, it may also be disposed to substantially link the flux in the armature and rails, to assist in rapidly commutating current to the impedance 25.

Figure 2:
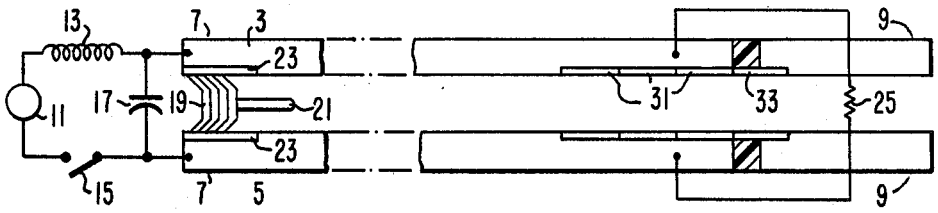
FIG. 2 is an alternative embodiment of this invention.

The muzzle end 9 of the rails may be formed of an insulating material 27 as shown in FIG. 1; or the muzzle end 9 may be insulated from the rails by insulating material 29 disposed as shown in FIG. 2.

Resistive inserts 31 are disposed in the rails 3 and 5 and extend into the muzzle portions 27, as shown in FIG. 1. The inserts 31 are so disposed that the resistivity increases in the direction of the muzzle or as the distance to this muzzle decreases. The length and number of inserts 31 is determined by the resistivity of the insert 31, the speed of the projectile 21 and the rate at which it is desired to commutate the current to the muzzle impedance 25. If the muzzle end 9 of the rails 3 and 5 are not made of an insulating material, it is desirable to have an insulating insert 33 disposed on the muzzle end of this resistive inserts 31. This will ensure complete arc extinction thereby preserving the integrity of the muzzle end of the rails for straightness to ensure a good trajectory. It will also provide a renewable portion should arcing cause deterioration beyond an acceptable level.

The arrangements shown in FIGS. 1 and 2 add a second impedance in series with the driving current either utilizing resistive inserts 31 or a combination resistive inserts and arcs, to commutate the current to the first-mentioned impedance 25 connected across the rails adjacent the muzzle; and since the muzzle end is long, the arcs are confined within the barrel and not generally externally visible.

What is claimed is:

1. An electromagnetic projectile launcher comprising:

a pair of generally parallel conductors having a breech and a nozzle end;

means for conducting current between said conductors and for accelerating said projectile;

a source of high current connected to said conductors;

a first impedance disposed across said conductors adjacent the muzzle end thereof; and a second impedance disposed in at least one of said conductors on the muzzle side of where said first impedance is connected across said conductors, said second impedance increasing in resistivity as the distance to the muzzle decreases;

whereby current is commutated to said first impedance to suppress muzzle arcing.

2. An electromagnetic projectile launcher as set forth in claim 1, wherein the second impedance comprises resistive inserts disposed in one of said conductors, the resistivity of the inserts increase as the distance to the muzzle decreases.

3. An electromagnetic projectile launcher as set forth in claim 2 and further comprising an insulating insert on the muzzle end of the resistive inserts.

4. An electromagnetic projectile launcher as set forth in claim 1, wherein the second impedance comprises resistive inserts disposed in each of said conductors so that the resistivity increases as the distance to the muzzle decreases.

5. An electromagnetic projectile launcher as set forth in claim 4 and further comprising an insulating insert on the muzzle end of the resistive inserts disposed in each conductor.

* * * * *